United States Patent [19]

Giardini et al.

[11] 4,446,825

[45] May 8, 1984

[54] INTERNAL COMBUSTION ENGINE WITH VALVES HAVING A VARIABLE SPRING RATE

[75] Inventors: Dante S. Giardini, Dearborn Heights; Richard V. Iwanski, Belleville; David K. Trumpy, Farmington Hills, all of Mich.

[73] Assignee: Ford Motor Company, Dearborn, Mich.

[21] Appl. No.: 369,060

[22] Filed: Apr. 16, 1982

[51] Int. Cl.[3] ..... F01L 3/10

[52] U.S. Cl. ..... 123/90.65; 123/90.15

[58] Field of Search ..... 123/90.12, 90.14, 90.15, 123/90.16, 90.27, 65, 188 SA; 474/104, 109, 110, 138

[56] References Cited

U.S. PATENT DOCUMENTS 2,342,003 2/1944 Meyer .

FOREIGN PATENT DOCUMENTS 212504 1/1958 Australia ..... 474/110

2926327 1/1981 Fed. Rep. of Germany ... 123/90.16

*Primary Examiner*—William R. Cline

*Assistant Examiner*—Peggy A. Neils

*Attorney, Agent, or Firm*—Joseph W. Malleck; Olin B. Johnson

[57] ABSTRACT

An apparatus for controlling and varying the closing force of intake or exhaust valves for an internal combustion engine. Hydraulic system, responsive to a minimum high speed condition of the engine, is used to increase the spring rate of the valve closing springs. The hydraulic system also reduces the spring rate when the engine falls below such speed condition. A spring biased idler pulley is also used to maintain adequate tension on a belt, providing drive to the camshaft for the valves. Adjustment apparatus is associated with the spring biased idler pulley for controllably increasing the spring rate for biasing when the engine speed is above a minimum condition and for decreasing the spring rate when the engine speed is below the minimum condition.

9 Claims, 6 Drawing Figures

INTERNAL COMBUSTION ENGINE WITH VALVES HAVING A VARIABLE SPRING RATE

BACKGROUND OF THE INVENTION AND PRIOR ART STATEMENT

Considerable effort has been given to improving fuel consumption in automobiles. The principal avenues for achieving improvement are through reduced vehicle weight, improved combustion process, reduced aerodynamic drag, reduced wheel rolling friction, and reduced engine friction. Engine friction can be present where moving parts are in engagement, the principal ones being the valve operating train with a variety of contacts through sleeve and stem interengagements, rocker arm pivoting, and camshaft engagement of tappets, all of which attempt to convert the rotary motion of a camshaft into the linear motion of the valve stem.

Due to efforts to improve fuel efficiency through methods other than reduced friction, the sum total of engine friction has been somewhat increased in recently designed engines. For example, in engines employing the hemi-head cylinder construction, the rearrangement of the intake and exhaust valves about a spherical surface causes the valve axes to be oriented in unusual patterns. The use of skewed rocker arms operating about a single overhead camshaft promotes side loading forces which results in increased friction. The valve stem is embraced by a spring effective to exert a closing force on the valve, the valve opening being accomplished by the rocker arm overcoming such spring. The spring force is always high to accommodate operating at high speeds. Much greater spring forces are required to provide sufficient closing force to overcome the inertia of the valve. With the necessity for such heavier springs and the accompanying additional side loading frictional forces, the engine friction force, at medium to low load conditions, is undersirably high.

Prior attempts have been made to vary the closing force of the internal combustion engine valves by use of a variable fulcrum (see U.S. Pat. No. 4,134,371), by varying the stroke adjustment of the valve operating train (see U.S. Pat. No. 4,187,810), and by selectively using hydraulics to assist the spring closing force (see U.S. Pat. No. 2,342,003). However, all of these patents fail to affect the original design of the spring element used for the closing force at low speed conditions. The springs in these patents, being designed primarily for high speed conditions, are also operative at the low speed conditions without change even though the valve leverage system may be adjusted upstream from the spring. Thus there is no net reduction in engine friction as a result of such valve train adjustment.

Several prior art approaches have been made in an effort to augment the spring force under high speed conditions such as by use of pressurized hydraulic fluid to add to the spring force (see U.S. Pat. No. 2,342,003).

Another area for high friction is the drive system used to interconnect the engine crankshaft with various driven components such as the camshaft and water pump. Belts, designed to have a serpentine path, engage more than one driven pulley, requiring an idler pulley to maintain tension in the belt and ensure satisfactory timing and drive of the driven members. Considerable friction is imparted as a result of applying sufficient tension to a belt with such a path. In conditions where engine vibration permits, it is desirable if the belt tension can be removed so as to release some side loading on the bearing of the driven members as well as input members. Prior art devices have attempted to vary the belt tension on idler pulleys, such as in U.S. Pat. Nos. 3,496,918; 3,888,217; and 4,077,272. In each of these patents, side loading of the pulleys receiving drive were not relieved of friction by moving the idler pulley; instead, side loading was increased by angulating the idler pulley support with respect to the belt path in an attempt to vary the valve timing, thereby lengthening one side of the belt train as opposed to the other side and thus changing the valve timing. These devices have had little effect upon changing the belt friction forces operating on the bearings and therefore are ineffective in reducing engine friction, particularly during high speed operating conditions.

SUMMARY OF THE INVENTION

The invention is an apparatus for controlling the operational event of valves in an internal combustion engine; the engine having a camshaft driven by the crankshaft through a belt. The apparatus is activated for opening the valves by the conversion of rotary motion from a camshaft into linear motion of a valve stem; the valve stem being normally moved to a closed position by a spring. The apparatus comprises hydraulic means responsive to a minimum high speed condition of said engine for increasing the spring rate of the valve closing spring and for reducing the spring rate of the valve closing spring below said minimum engine speed. The apparatus also comprises a second hydraulic means which includes a spring biased idler pulley for maintaining the tension on said belt. The hydraulic means is responsive to said minimum high speed engine condition for decreasing the rate of the spring biasing said idler pulley and for increasing said spring rate when the engine speed is below said minimum value.

The apparatus particularly changes the spring rate of the springs used for the valve actuation and changes the spring rate of the springs used for applying tension to the belt, the latter being used to drive the camshaft and water pump. It is preferable that the minimum engine speed above which the spring rate is reduced be about 2500 rpm for most engines, although the minimum high speed may be selected in the range of 1800–2500 rpm. The spring forces in a typical internal combustion engine having an overhead camshaft can have closing spring forces which are five times greater than needed at relatively lower speeds of about 1000 rpm. By reducing the spring rate to preferably one-half its normal calibration during high speed conditions, the tangential force applied to the camshaft of the engine can be reduced by at least 5 ft/lbs in a 1.8 liter engine. This reduction in friction force will result in a fuel consumption saving of at least 4–5%.

It is advantageous if the means for changing the spring rate comprises a cylinder and piston, the piston operating as a shoulder against which one end of the valve closing spring bears. By injecting hydraulic fluid to move the position of said piston, the spring rate can be varied to the desired degree. Similarly, it is advantageous if the spring rate for the idler pulley can be varied by a cylinder and piston, the piston operating as one surface against which the spring bears. Both piston and cylinder devices may be operated from a common hydraulic source, the communication to said piston and cylinder devices being preferably controlled by a solenoid actuated three-way valve responsive to a speed signal received from the engine. Such speed signal may be generated by a device that is responsive to oil pressure, which in turn is proportional to engine speed.

DETAILED DESCRIPTION

Figure 1:
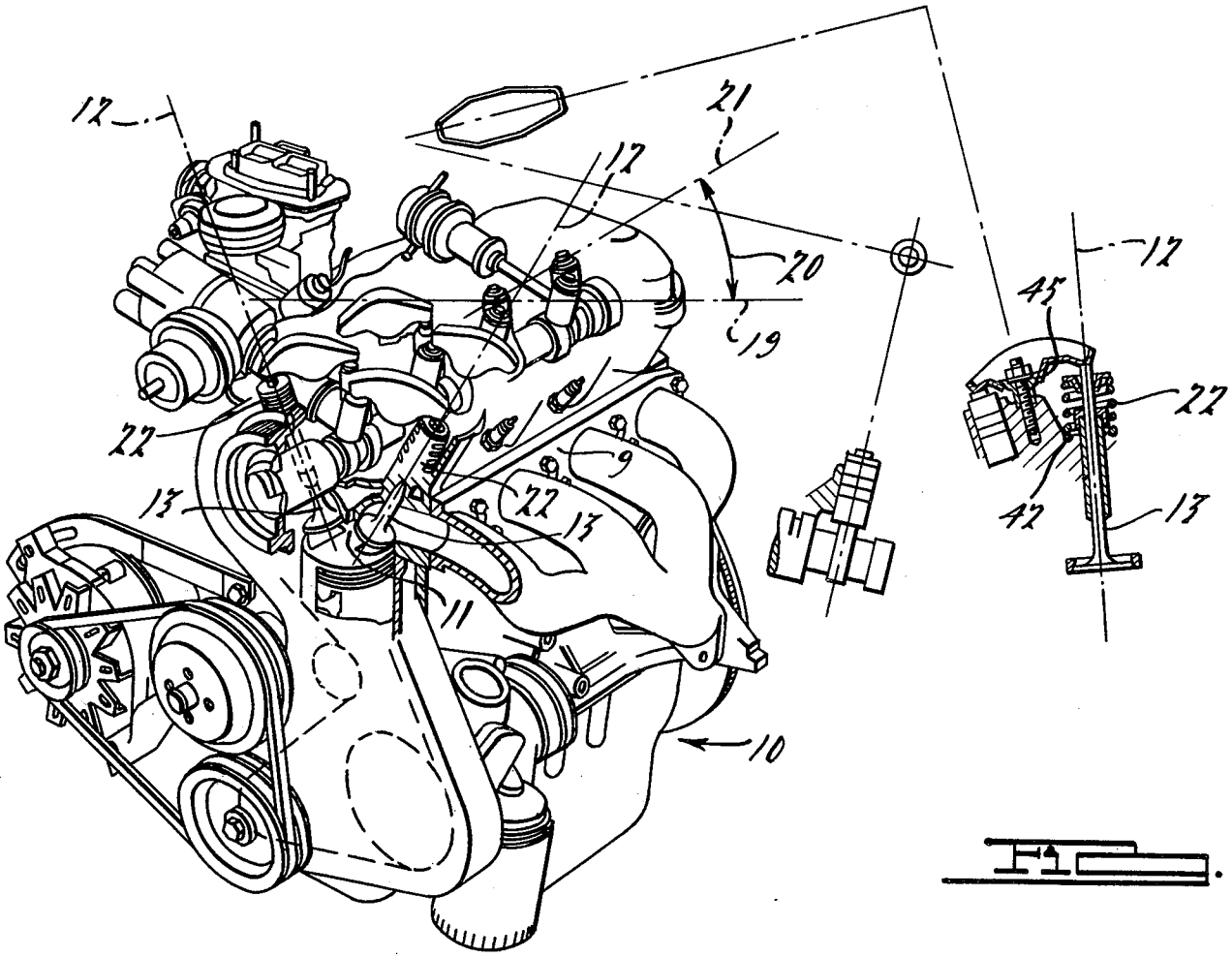
FIG. 1 is a perspective view of a new generation engine in the prior art illustrating the intricate valve train and camshaft drive which experiences an undesired level of friction at some points to accommodate other modes of decreasing fuel consumption.

Turning now to FIG. 1, an example of a modern engine 10 designed to improve fuel economy through improved combustion is illustrated. This prior art engine is of the hemi-head type; that is, the head 9 for the engine block is designed so that the roof 11 of the combustion chamber has a hemispherical configuration which improves mixing and thorough burning of the fuel mixture during compression and expansion. But the hemi-head configuration dictates that the axes 12 of the valves 13 be oriented in paths that are quite different than the orientation for the prior art valve stems. The prior art valve stems are typically oriented to lie in a plane that is laid over in a manner such that the low speed friction will be increased.

Figure 3:
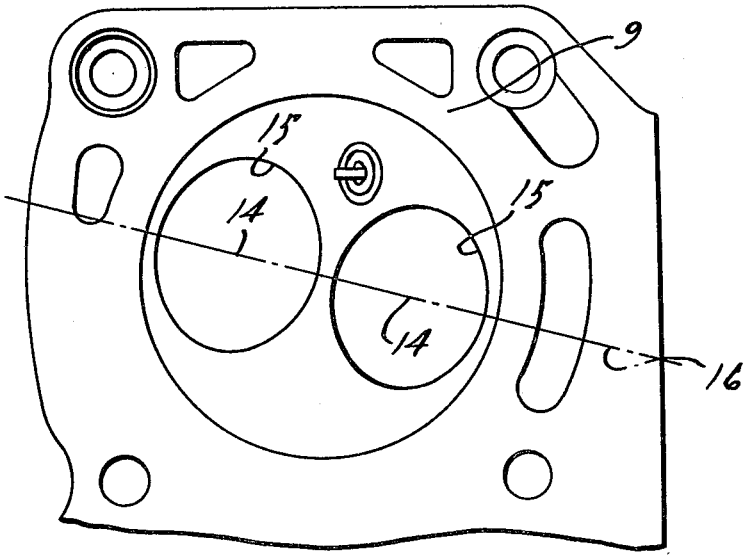
FIG. 3 is a bottom view of the hemi-head of the engine shown in FIG. 1.

As shown in FIG. 3, the centers 14 of the openings 15 for the valve ports into the combustion chamber are aligned in a diametrical plane 16. As a result, the camshaft operating system 17 must be arranged in an offset or skewed fashion. Each rocker arm 18 pivots in a plane 19 that makes an angle 20 of about 30° with the north-south center line 21 of the engine. Due to the side loading forces on the pivoting and moving parts, an increased spring force imparted by springs 22 to facilitate an overhead cam actuation mode is required. As a result, the friction between the moving parts of the cam actuating system 17, applying a tangential force at the camshaft 23, can be 20–40% of the total engine friction. For example, such tangential force at the camshaft can be 5 ft/lbs due to the cam/valve actuation system in an engine that has a total engine friction force of 12 ft/lbs. At part load conditions (in the range of 1000–1800 rpm), the friction force is maximized and the spring force offers a resistance five times the force that is experienced in high load conditions (in excess of 2000 rpm). This tangential force is about 80 pounds.

In this type of modern engine, weight is reduced by combining the drive of several components through a single belt 25 connecting the output shaft 26 of the engine with pulleys 27–28 for the camshaft 23 and the water pump, respectively. This necessitates an idler pulley 30 which applies side forces to the belt 25 to maintain adequate tension. However, the idler pulley 30 imparts side loads to the roller bearings 31 supporting the pulleys 27–28, thereby increasing the total friction significantly in this drive system.

To reduce friction, this invention provides apparatus means 32*a* and 32*b*, first means 32*a* for controlling the operational event of the valves in a manner to change the spring rate of the springs 22 which force closure of the engine valves 13, and second, in a preferred circumstance, means 32*b* for changing the spring rate of a spring bias maintaining belt tension in a belt drive for components of the engine.

Figure 2:
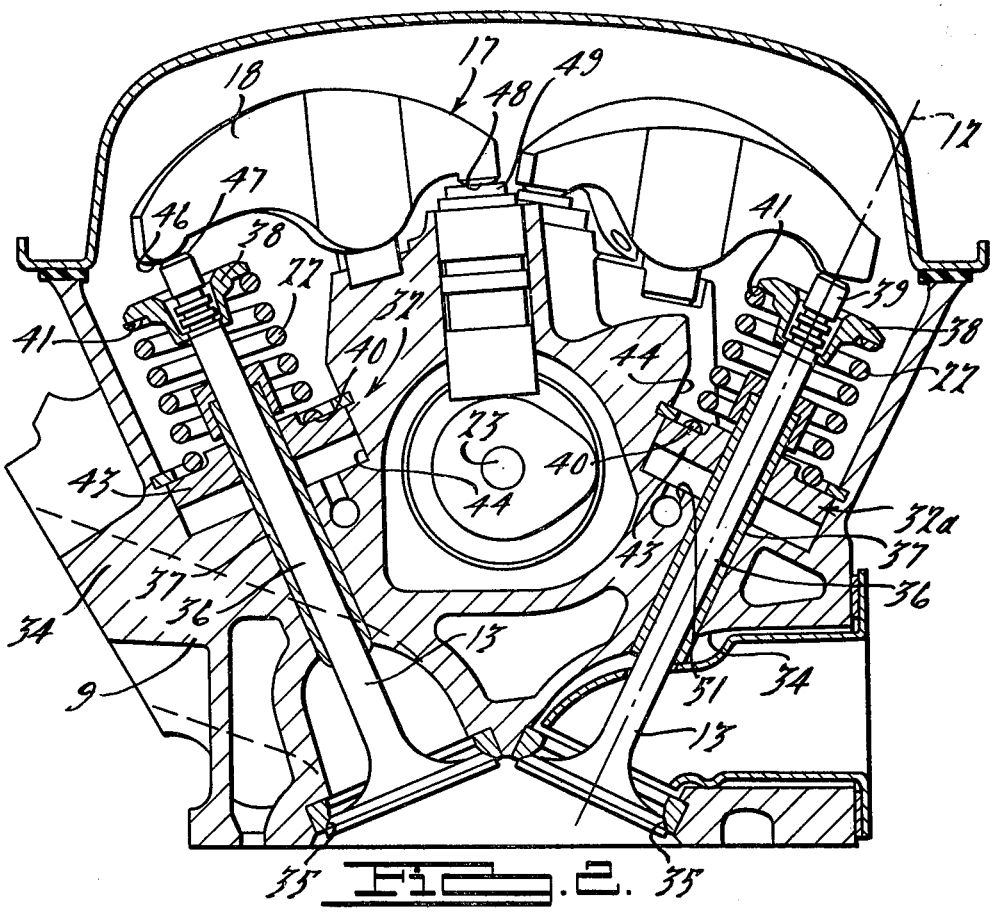
FIG. 2 is an enlarged sectional view of an engine incorporating some of the features of the present invention including means for varying the spring rate of the springs used to activate the valves.

Turning to FIG. 2, the engine apparatus associated with the invention herein for controlling the operational event of the valves 13 comprises a head 9 which is constituted of an aluminum casting with cast passages 34 defining the intake and exhaust ports. Intake and exhaust valves 13 are arranged to close the intake and exhaust ports 35, the valves 13 each having a stem 36 extending through a sleeve guide cylinder 37 having an axis 12 oriented to be perpendicular to a tangent passing through the center 14 of an exhaust port or intake port. The actuating system 17 for the valves is comprised first of a closing spring 22 effective to provide a closing force for the valve. The spring 22 has one end 41 bearing between an internal ring element 38 attached to a selected groove of the valve stem end 39. The other end 40 of the spring, heretofore in the prior art, has typically engaged a shoulder 42 defined on the casting head or some other suitable fixed surface (see FIG. 1).

In this invention, a piston element 43 is employed which rides on the valve sleeve 37 and operates within a fluid actuating chamber 44. Sheet metal rocker arms 18 pivot about spherical member 45 located at staggered positions along line 21. One end 46 of the rocker arm bears against the outer tip 47 of the valve stem, and the inner end 48 of each of the rocker arms is arranged to engage a hydraulic cam follower 49, which in turn is engaged and moved by a cam surface 50 on the camshaft 23. The use of hydraulic cam followers is desirable because they reduce shock forces at high speeds by virtue of their internal construction. However, side loading resulting from the nonsymmetrical system 17 promotes valve train friction as well as decreased contact wear life.

Figure 4:
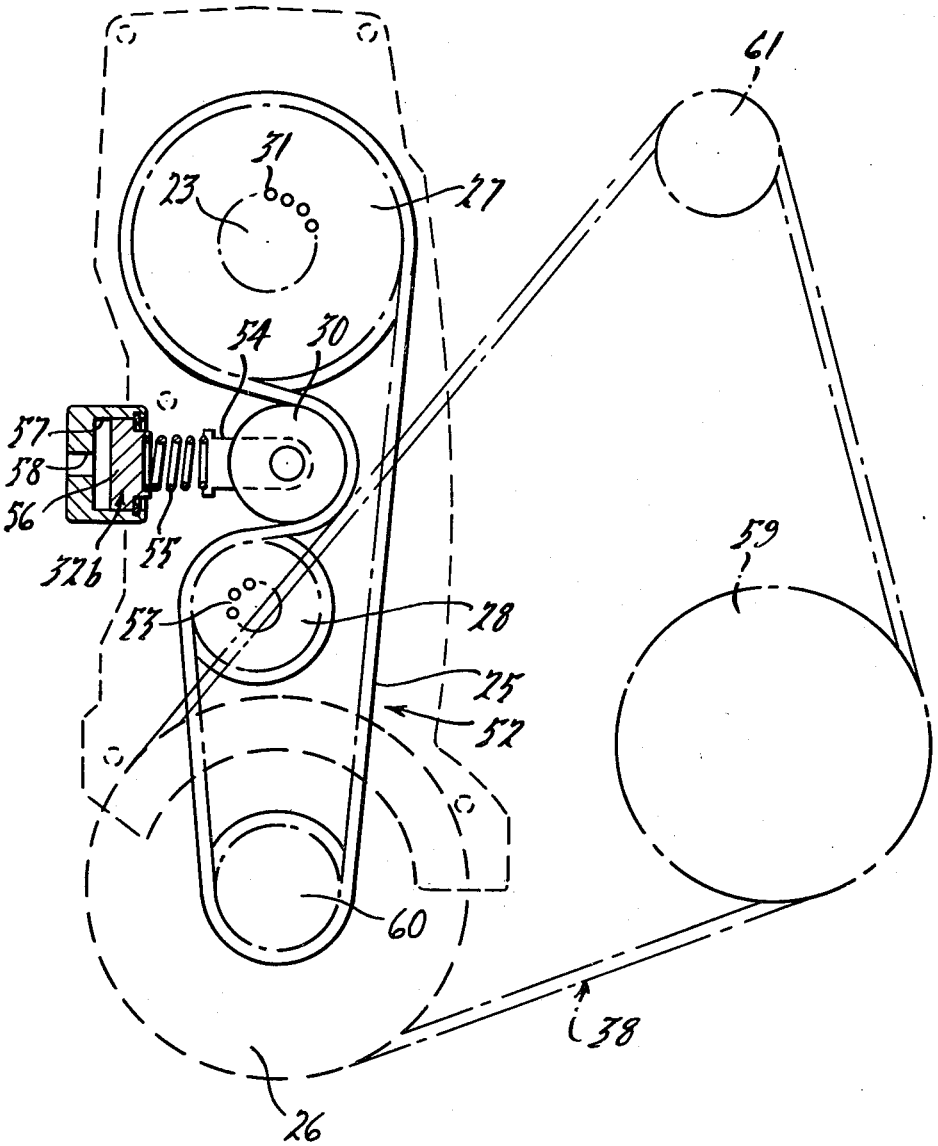
FIG. 4 is a schematic illustration of the belt drive between the crankshaft and camshaft as well as other auxiliary driven means of the engine of FIG. 1.

The drive system for driving the camshaft 23 and water pump is typically carried out by a system 52 (as shown in FIG. 4). The other drive system 38 connects the alternator input 59 with the crankshaft 60 and air conditioner input 61. Drive for the system is taken from the engine crankshaft 60 which carries a suitable belt drive pulley element 26. The water pump has a pulley 28 at one end of its shaft, which in turn also ia supported by a plurality of roller bearings 53. The camshaft 23 is rotated by a pulley 27, mounted at one end thereof, supported by a plurality of roller bearings 32. The camshaft pulley 27 and the water pump pulley 28 operate as driven members with respect to the belt drive 25. The belt drive 25 must assume a serpentine configuration to apply sufficient force to each of the driven pulleys, necessitating the use of an idler pulley 30 operating on the outside of the belt to maintain proper belt tension. The idler pulley is mounted on a yoke 54, which in turn is biased by a spring 55 grounded on piston member 56.

The apparatus means firstly comprises means 32*a;* the piston 43 and cylinder chamber 44, and a drilled passageway 51 for carrying pressurized oil to the piston chamber 44; the drilled passageway 51 being in communication with a suitable source of hydraulic pressure. The apparatus means secondly comprises means 32b: a piston 56 and cylinder 57, and a drilled passageway 58 for pressurized oil to the chamber 57. The position of piston 56 controls the spring rate of the spring 55 biasing the idler pulley.

Figure 6:
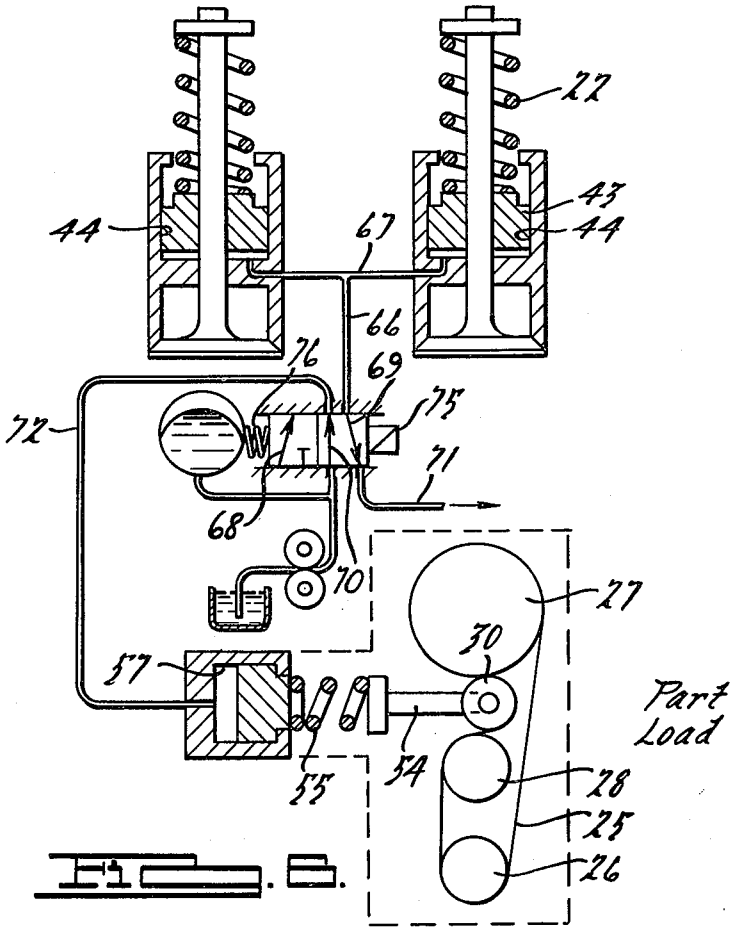
FIGS. 5 and 6 are schematic operating diagrams illustrating, respectively, the preferred positioning of the controls for reducing the spring rate of the valve springs in the high speed condition and for increasing the spring rate of the valve springs in the part load condition.
Figure 5:
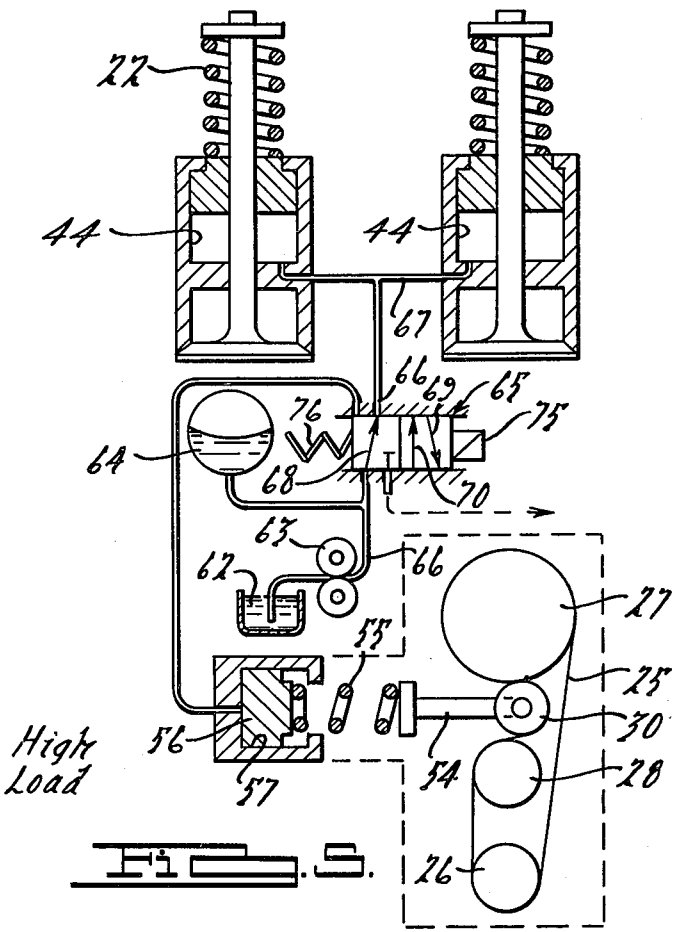

Turning now to FIGS. 5 and 6, there are shown two operational modes for the apparatus means. In FIG. 5, for high speed conditions, a source of fluid is provided by a pump 63 drawing hydraulic fluid from a sump 62, which in turn feeds such pressurized fluid to a reservoir 64 and, when permitted by the three-way directional valve 65, is transmitted by way of channel 66 to the bifurcated channel 67 which feeds to each of the engine oil passageways 51 leading into the cylinder chambers 44. The three-way control valve has one fluid path 68 which when aligned with passage 66 permits fluid to pass through the valve when the other fluid paths 69 and 70 are blocked. No pressurized fluid is transmitted in this mode to the piston chamber 57. Thus spring 22 is biased to a high spring rate and spring 55 is biased to a low spring rate.

When the valve 65 is indexed to a new position (as shown in FIG. 6 for part load conditions), the fluid is permitted to pass through path 69 of the valve in the opposite direction to a line 71 connected to sump and through path 70 to convey pressurized fluid along line 72 to cylinder chamber 57 for biasing spring 55 to a high rate spring 22.

The three-way directional control valve 65 is indexed to each of its positions in accordance with the speed of the engine. A suitable electric signal can be taken from the oil pressure for the engine which is proportional to engine speed. For example, the pressure can be selected so that at engine speeds above 2000 rpm an electric signal is transmitted that actuates a solenoid 75, which in turn allows the directional valve to move with a spring 76. The flow of hydraulic fluid to the cahmbers 44 or 57 is controlled so that the spring rate for the head valve spring increases while the spring rate for the idler pulley spring is decreased. If the engine speed shou1d fall below 2000 rpm, preferably in the range of 1000–1800 rpm, which is commensurate with part load conditions for the engine, the oil pressure will generate a signal such that the solenoid 75 will be energized, moving the directional valve to its other indexed position, preventing pressurized hydraulic fluid from being transmitted to the chamber 44, causing the spring rate for the head valve spring to be reduced, while transmitting fluid to cause the spring rate for the idler pulley spring to be increased. The use of increased belt tension at part load conditions leads to reduced friction at high speed conditions. It has been found that to reduce spring tension at low speed conditions leads towards excessive engine vibration and does not decrease engine friction.

We claim:

1. In an internal combustion engine having a crankshaft, a camshaft, and a timing belt interconnecting said crankshaft and camshaft, an apparatus for controlling the operational event of valves in said internal combustion engine, said valves being moved to a closed position by a spring and activated for opening by the conversion of rotary motion from said camshaft into a linear opening motion of the valve, the apparatus comprising:

(a) first hydraulic means responsive to an increase at or above a minimum high speed condition of said engine for increasing the spring rate of said valve closing spring and for reducing the spring rate under said minimum high speed condition;

(b) second hydraulic means having a spring biased idler pulley for maintaining tension on said belt, said second hydraulic means being responsive to an increase at or above said minimum high speed condition for decreasing the rate of said spring biasing idler pulley and for increasing said tension when said engine speed is below said minimum high speed condition.

2. The apparatus as in claim 1, in which the first hydraulic means comprises a source of pressurized fluid, a cylinder and a piston operable within said cylinder, the position of said piston affecting the spring rate for said closing spring.

3. The apparatus as in claim 1, which further comprises a control valve and controls for making said hydraulic means responsive to said minimum speed condition of said engine, said controls comprising a signal responsive to the speed of said engine for actuating said control valve, said control valve permitting fluid communication in one direction therethrough when in one position and for blocking fluid communication in an opposite direction when in another position.

4. In an internal combustion engine having a camshaft driven by a crankshaft by way of a driving belt, the apparatus for controlling the operational event of valves in the internal combustion engine, said valves each having a stem normally moved to a closed position by a spring, said valves being activated for opening by the conversion of rotary motion of said camshaft into a linear motion of the valve stem, the apparatus comprising:

(a) hydraulic means responsive to an increase at or above a minimum high speed of said engine for increasing the spring rate of said valve closing spring and for reducing the spring rate of said valve closing spring when said engine is operating under said minimum high speed condition; and (b) spring biased idler pulley for maintaining tension on said belt, said pulley having second means responsive to an increase at or above said minimum high speed engine condition for decreasing the rate of said spring biasing of said idler pulley and for increasing said spring rate biasing of said idler pulley when engine speed is below said minimum high speed condition.

5. The apparatus as in claim 4, in which said hydraulic means comprises a source of pressurized fluid, a cylinder and a piston operable within said cylinder effective to position one end of said spring for determining the spring rate thereof, and a control for regulating the admission and relief of hydraulic fluid from behind said piston for effecting a change in position of said piston and thereby said spring rate.

6. The apparatus as in claim 4, in which said spring biased idler pulley comprises a compression spring having one end bearing against a slidable idler pulley in contact with said driving belt, a cylinder and a piston operable to engage the other end of said compression spring for determining the spring rate thereof in response to the presence or absence of pressurized fluid in said cylinder.

7. The apparatus as in claim 5, in which said control comprises a solenoid actuated three-way valve effective to provide for the presence or absence of pressurized fluid in said cylinder to determine one of two spring rates.

8. The apparatus as in claim 4, in which said minimum high speed condition of said engine is in the range of 1800–2500 rpm.

9. The apparatus as in claim 4, in which said first hydraulic means and second means spring biased idler pulley are each operated in opposition to control their associated spring and spring biasing at opposite spring rates, whereby when the engine condition is in a high speed condition the spring rate of said valve closing spring is increased and the spring rate of said spring biasing of the idler pulley is decreased.

* * * * *